United States Patent [19]

Taylor

[11] 3,953,902

[45] May 4, 1976

[54] WATER CLOSET ADDITIVE MEANS

[75] Inventor: Glenn N. Taylor, Cary, Ill.

[73] Assignee: Colgate-Palmolive Company, New York, N.Y.

[22] Filed: Jan. 17, 1975

[21] Appl. No.: 541,745

[52] U.S. Cl. ..... 4/227; 222/86; 222/180; 222/400.7

[51] Int. Cl.[2] ..... E03D 9/02; B67D 5/06; B65D 83/06

[58] Field of Search ..... 222/192, 373, 400.7, 222/394, 85, 86, 180; 4/222, 223, 224, 225, 226, 227, 228, 229, 230, 231, 232

[56] References Cited

UNITED STATES PATENTS

| | | | |
|---|---|---|---|
| 495,563 | 4/1893 | Plumb | 4/228 |
| 853,434 | 5/1907 | Blackmere | 4/222 |
| 1,728,737 | 9/1929 | Stoner | 4/227 |
| 1,749,312 | 3/1930 | Blair | 222/373 X |
| 2,658,206 | 11/1953 | Martinez | 4/228 |
| 2,839,763 | 6/1958 | Newsom | 4/227 |
| 3,200,994 | 8/1965 | Levinson et al. | 222/400.7 |
| 3,342,338 | 9/1967 | Selmeczi et al. | 4/227 X |
| 3,374,927 | 3/1968 | Schmidt | 222/400.7 |

FOREIGN PATENTS OR APPLICATIONS

| | | | |
|---|---|---|---|
| 597,267 | 1/1948 | United Kingdom | 4/227 |

*Primary Examiner*—Allen N. Knowles
*Assistant Examiner*—Hadd Lane
*Attorney, Agent, or Firm*—Powell L. Sprunger

[57] ABSTRACT

A device for introducing an additive liquid into a tank of a water closet. When the water closet is flushed and the water level in the tank lowers from a first normal level to a second lower level, air is admitted into conduit means. As the water level later rises from the second level toward the first level, the admitted air is forced through the conduit means into a container, containing an additive liquid, where it is compressed. The compressed air forces a portion of the additive liquid through conduit means and into the water in the tank.

46 Claims, 9 Drawing Figures

WATER CLOSET ADDITIVE MEANS

BACKGROUND OF THE INVENTION

The present invention relates to devices for introducing an additive material into a water closet.

Before the present invention, a various assortment of devices have been proposed for introducing additives into water closets. Water closets used with such devices generally have a tank for retaining a supply of water which passes out of the tank into a bowl of the water closet during flushing of the closet. The tanks are provided with covers which must be removed to obtain access to the inside of the tanks.

The prior art additive devices have suffered from a number of deficiencies. In the past such devices have been placed inside the tanks, and the bulky tank covers must thus be removed from the tanks each time a unit or replacement part thereof is positioned in the tank. Some of the devices are placed on the tank bottoms, and the user necessarily wets his hands with tank water during removal of the devices from the tanks. The user's hands may also become stained with the coloring dye utilized in the devices, and the tank water and dye may also be inadvertently spilled outside the tank during removal. Many of the devices are difficult to place in the tanks due to their relatively large bulk or due to limited space in the tanks. Replacement of devices which are located on the tank bottom may require flushing the water closet twice, once during removal of the used device and once during placement of the new device.

It has also been found that previous devices frequently release either too large or small an amount of additive material into the tank water. In the former case, the large amount of release results in waste of the additive material and discoloration of the water, while in the latter case the device does not serve its intended purpose. Some of the devices are provided with valves which occasionally become separated from the devices in the tanks, resulting in inoperability of the devices and possible damage to the water closet by the valves. Since the additive materials in such devices are normally placed directly into the relatively large volume of water retained in the tanks, the use of deodorizers in such additive materials would normally not be effective, since they become diluted by the large volume of water.

SUMMARY OF THE INVENTION

A principle feature of the present invention is the provision of a device for introducing an additive liquid into a water closet which permits simplified use.

The device of the present invention may be utilized in a water closet of the type having a tank for retaining a flushing liquid which lowers and rises between a first upper level and a second lower level during flushing. The device of the present invention comprises, container means for retaining the additive liquid. The device has first conduit means communicating between the container means and inlet opening means positionable in the tank intermediate the first and second levels of the flushing liquid to admit air into the first conduit means when the flushing liquid lowers below the inlet opening means. The inlet opening means is positionable sufficiently below the first level for the flushing liquid to force air through the first conduit means into the container means as the flushing liquid rises above the inlet opening means toward the first level. The device has one-way valve means associated with the first conduit means for permitting passage of air from the inlet opening means to the container means and for preventing passage of fluid from the container means to the inlet opening means. The device also has second conduit means communicating between the additive liquid in the container means and outlet opening means positionable in the tank for passage of additive liquid into the flushing liquid.

A feature of the present invention is that the air forced into the container means during flushing forces a portion of the additive liquid from the container means through the second conduit means and outlet opening means into the flushing liquid.

Another feature of the present invention is that the device delivers an approximately equal amount of additive liquid into the tank during each flushing of the water closet.

Yet another feature of the invention is that the device eliminates parts which may become separated during use, which might otherwise damage the water closet.

Still another feature of the invention is that the device may be readily placed into its proper position on the water closet prior to its initial use.

A feature of the present invention is that in a preferred embodiment the container means is located outside the tank after placement of the device.

Another feature of the invention is that the container means is preferably removably attached to the first and second conduit means.

Yet another feature of the invention is that the container means is readily located for easy replacement outside the tank.

A feature of the invention is that the container means may be replaced without removal of the cover from the tank.

Thus, another feature of the invention is that the user may replace the container means without contacting the tank liquid with his hands.

Yet another feature of the invention is that the user may replace the container means without spilling the additional liquid and without staining his hands.

Still another feature of the invention is the provision of signal means in the additive liquid for indicating when the used container means is nearly empty and due for replacement.

A feature of the invention is the provision of means for capturing a portion of the additive liquid in the tank above the first level of the flushing liquid.

Another feature of the invention is the provision of a deodorizer in the additive liquid which is dissipated from the captured liquid while being undiluted by the tank water.

Still another feature of the present invention is the provision of means for selectively capturing the deodorized liquid or permitting it to pass into the tank water where it becomes diluted and is rendered ineffective.

A feature of the invention is that the container means is of simplified construction, and replacement of a used container means is of reduced cost.

Further features will become more fully apparent in the following description of the embodiments of this invention and from the appended claims.

DESCRIPTION OF THE PREFERRED EMBODIMENT

Figure 1:
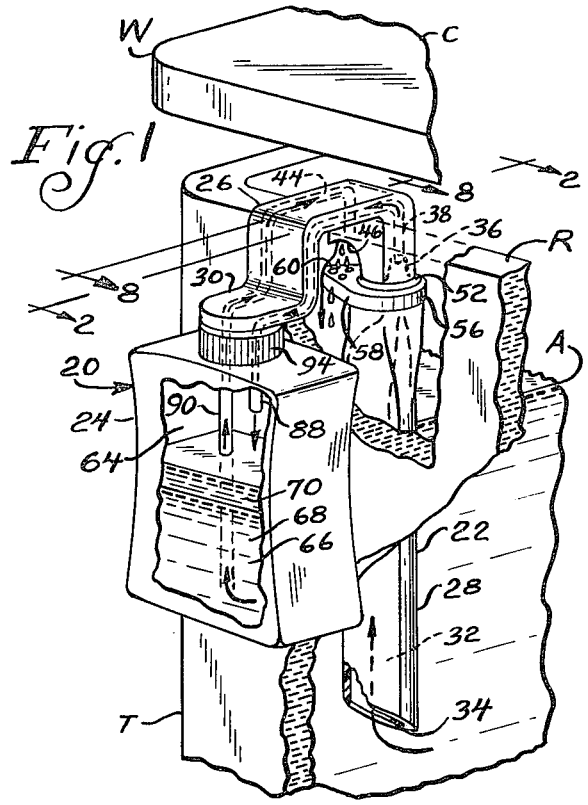
FIG. 1 is a perspective view, partly broken away, of an additive device of the present invention as positioned on the tank of a water closet.
Figure 2:
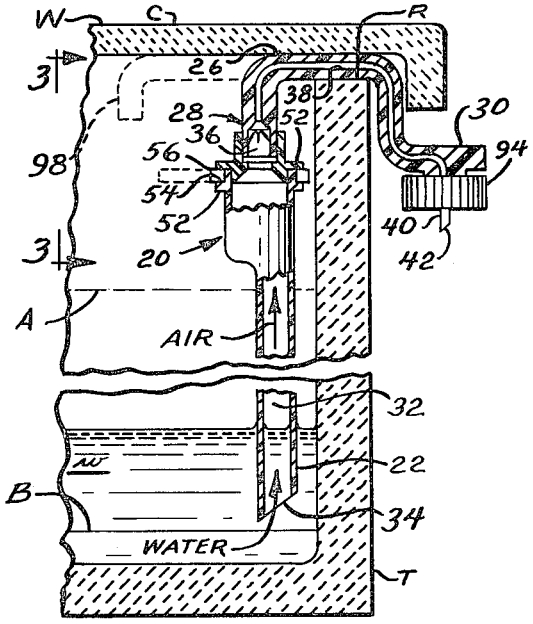
FIG. 2 is a fragmentary elevational view, taken partly in section, and taken substantially as indicated along the line 2—2 of FIG. 1.
Figure 8:
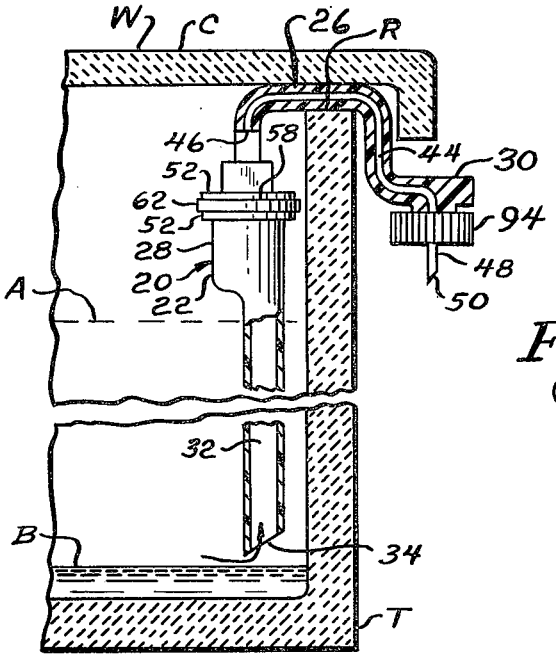
FIG. 8 is a fragmentary elevational view, taken partly in section, and taken substantially as indicated along the line 8—8 of FIG. 1.

Referring now to FIGS. 1, 2 and 8, there is shown a water closet W having a tank T for retaining a supply of water *w*. The water *w* is normally retained in the tank at a first level A. During flushing of the water closet, the water or flushing liquid flows from the tank T into a bowl (not shown) of the water closet, while the water level in the tank T lowers to a second lower level B. The tank T is then filled by apparatus (not shown) and the water level rises to its first level A, after which filling of the tank T is stopped.

A cleaning device generally designated 20 is also shown having a connector 22 and a container 24 removably attached to the connector 22. The connector 22 has a central portion 26 adapted for placement on a rim R of the tank at its upper end, a first end portion 28 depending from one end of the central portion 26 for placement inside the tank, and a second end portion 30 depending from the other end of the central portion 26 for placement outside the tank T. When the connector 22 has been initially placed in its proper position with the first end portion 28 inside the tank and the second end portion 30 outside the tank, a cover C for the tank T is placed over the tank and the central portion 26 of the connector 22, as shown in FIGS. 2 and 8.

The first end portion 28 has an elongated air chamber 32, as shown in FIGS. 1, 2 and 8, which is vertically disposed in the tank T. The first end portion 28 also has an inlet opening 34 at the lower end of the first end portion and communicating with the air chamber 32. The inlet opening or opening means 34 is located intermediate the first and second levels A and B, respectively, of the flushing liquid in the tank T, and is preferably located slightly above the lower second level B, for a purpose which will be described below.

Figure 3:
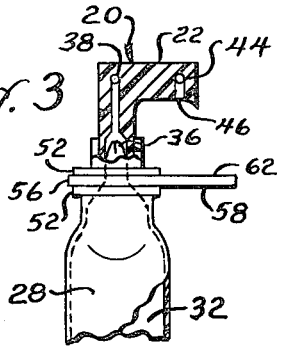
FIG. 3 is a fragmentary end view of the device, taken partly in section, and taken substantially as indicated along the line 3—3 of FIG. 2.
Figure 4:
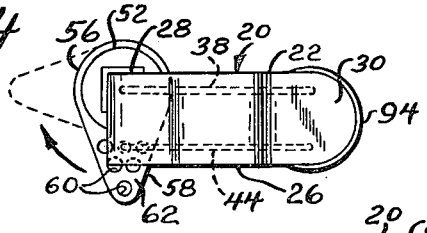
FIG. 4 is a top plan view of the device of FIG. 2.

As shown in FIGS. 1–3, the first end portion 28 has a one-way valve 36, such as a flap valve, permitting passage of air from the air chamber 32 into a first lumen 38, while preventing passage of fluid from the first lumen 38 into the air chamber 32. The first lumen 38 extends through the connector 22 and through a first tube section 40 depending from a lower end of the second end portion 30 of the connector. The first lumen 38 thus communicates between the valve 36 and a first aperture 42 adjacent the outer end of the first tube section 40.

As shown in FIGS. 1, 3, and 8, the connector also has a second lumen 44 which extends from an outlet opening 46 in the first end portion 28 located above the first level A of the flushing liquid, through the connector 22 and through a second tube section 48 depending from a lower end of the second end portion 30 of the connector 22. Thus, the second lumen 44 communicates between the outlet opening 46 and a second aperture 50 located at the outer end of the second tube section 48.

As shown in FIGS. 1–4, and 8, the first end portion 28 has a pair of spaced flanges 52 located above the first level A of the flushing liquid and defining an annular groove 54. An annular portion 56 of a ledge 58 is received in the groove 54, such that the ledge 58 may be rotated about the first end portion 28 of the connector 22. Thus, the outwardly extending ledge 58 may be moved between a first position below the outlet opening 46 and a second position spaced from a location below the outlet opening 46. The ledge 58 may have a plurality of recesses 60 in its upper surface 62 for a purpose which will be described below.

Figure 5:
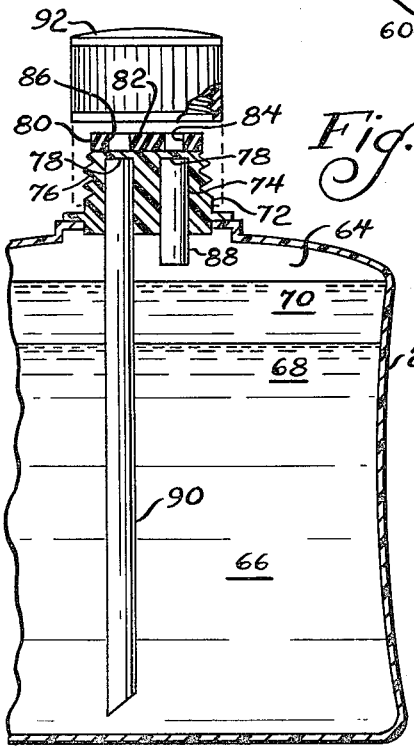
FIG. 5 is a fragmentary elevational view, taken partly in section of a container utilized in the device of the present invention.

As shown in FIG. 5, the container 24 has a chamber 64 for retaining an additive liquid 66. The additive liquid may comprise a cleaning solution such as a liquid having a surfactant, as known in the art, which cleanses the water closet without foaming. The solution may also include a bleach to remove stains from the bowl of the water closet. As shown, the liquid 66 may include a first liquid 68 having a first density, and a second liquid 70, having a second density which is less than the first density of the first liquid 68, such that the second liquid 70 floats above the first liquid 68, as shown. The second liquid 70 preferably has a color which contrasts with the color of the first liquid 68, for a purpose which will be described below.

The container 24 has a threaded top member 72 having first and second bores 74 and 76 extending partially through the top member 72, with a portion of the top member 72 forming a film 78 which covers the first and second bores 74 and 76. The container 24 has a resilient member 80 secured to an outer surface of the top member 72. The resilient member 80 has an outer sealing surface 82 and a pair of spaced openings 84 and 86 extending through the resilient member 80 and aligned with the first and second bores 74 and 76. The container 24 also has a first tube 88 received in the first bore 74 and communicating with an upper end of the chamber 64. The container 24 has a second elongated tube 90 having one end received in the second bore 76 and extending to a lower end of the chamber 64 where it communicates with the additive liquid 66. The container 24 may also have a threaded cap 92 which is removably attached to the threaded top member 72.

Figure 6:
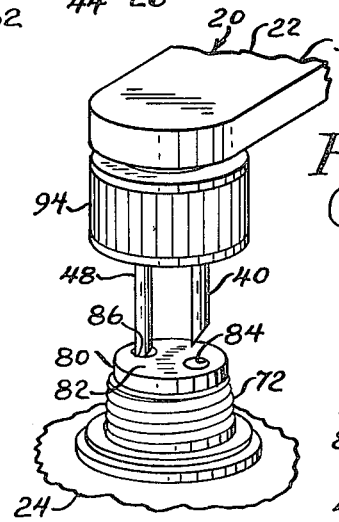
FIG. 6 is a fragmentary perspective view showing a connector in the device as being attached to the container.
Figure 7:
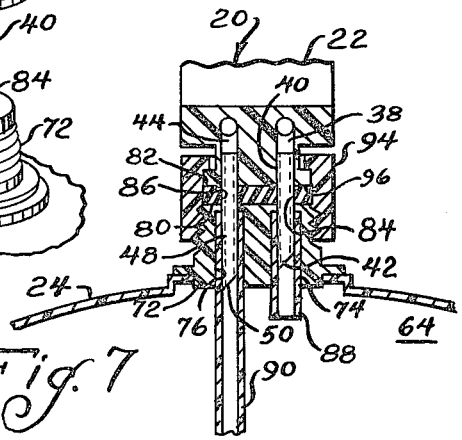
FIG. 7 is a fragmentary sectional view showing the connector as attached to the container.

The container 24 is removably attached to the second end portion 30 of the connector 22 as follows. As shown in FIG. 6, the container 24 is positioned below the first and second tube sections 40 and 48, respectively, after which the first and second tube sections 40 and 48 are passed into the openings 84 and 86. Suitable indicia (not shown) on the container may be utilized to indicate the correct position of the container for placement of the tube sections 40 and 48 into the openings 84 and 86. The container 24 is then pressed against the first and second tube sections 40 and 48 until the sharpened tube sections 40 and 48 puncture the film 78 which covers the first and second bores 74 and 76, after which the first and second tube sections 40 and 48 are passed into the first and second tubes 88 and 90, respectively.

The second end portion 30 of the connector 22 has a threaded nut or rim 94 rotably mounted on a lower end of the second end portion 30 and surrounding the first and second tube sections 40 and 48. When the first and second tube sections 40 and 48 are passed a sufficient distance into the first and second tubes 88 and 90, respectively, the threaded rim 94 is turned to engage the threads on the top member 72 of the container 24, such that the rim 94 draws the upper sealing surface 82 of the resilient member 80 against a lower sealing surface 96 of the second end portion 30. The threaded rim 94 is drawn sufficiently tight to slightly compress the resilient member 80 and cause engagement of the sealing surfaces 82 and 96, in order to prevent leakage from the container 24 and the first and second lumens 38 and 44. Thus, the container is readily attached to the second end portion 30 of the connector 22, with sealing engagement being made by rotating the threaded rim 94. In this configuration, the first lumen 38 communicates through the first tube section 40 and the first tube 88 with an upper end of the chamber 64, while the second lumen 44 communicates through the second tube section 48 and the second tube 90 with the additive liquid 66 adjacent a lower end of the chamber 64.

In use of the device, the connector 22 is initially placed on the tank T by removing the cover C and positioning the central portion 26 of the connector over the rim R of the tank T, as previously described, after which the cover C is placed over the tank and connector 22. As will be seen below, it is no longer necessary to remove the tank cover for attachment or replacement of containers. After initial placement of the connector, a container 24 containing an additive liquid 66 is secured to the second end portion 30 of the connector 22 by puncturing the sealing or covering film 78 of the container and by turning the threaded rim 94, as previously described. This completes the initial placement of the connector 22 and container 24 for initial use of the device.

When the water closet is flushed, the water supply in the tank T passes from the tank into the bowl (not shown) of the water closet, while the level of the water in the tank lowers from its first level A, as shown in FIG. 1, to its second lower level B, as shown in FIG. 8. In this configuration of the water closet, air is permitted to pass through the inlet opening 34 into the air chamber 32 of the first end portion 28, as indicated by the direction of the arrow in FIG. 8. As the water is subsequently filled into the tank, the water level in the tank T rises toward the first level A. During this time, the water w passes through the inlet opening 34 and into the air chamber 32, thus forcing the previously admitted air toward the upper end of the air chamber 32, through the one-way valve 36, the first lumen 38, the first tube section 40 and into the upper end of the chamber 64 in the container 24, as indicated by the direction of the arrows in FIGS. 1 and 2. Since the inlet opening 34 is located adjacent the lower second level B of the flushing liquid, a substantial volume of air is forced into the container 24 where it is compressed, while the one-way valve 36 prevents passage of the compressed air from the container 24 to the air chamber 32, particularly when the water level lowers in the tank.

The compressed air in the chamber 64 forces a portion of the additive liquid 66 through the second tube 90, the second tube section 48, the second lumen 44 and the outlet opening 46 where it falls onto the ledge 58. A portion of the additive liquid which passes from the outlet opening 46 is retained in the ledge recesses 60, while the remainder of the liquid flows over the sides of the ledge 58 and into the flushing liquid below. Thus, a portion of the additive liquid 66 is introduced into the water supply in the tank T responsive to flushing of the water closet, where it serves to treat the water *w* retained in the tank T and the water closet bowl (not shown) during subsequent flushing of the water closet. As shown in the drawings, the outlet opening 46 is preferably located at a level above the liquid in the container 24 to prevent possible siphoning of the additive liquid from the container into the tank.

The additive liquid 66 may also include a deodorizer, such as a perfume, which may be used to deodorize the room in which the water closet is located. The liquid may also include an anti-bacterial agent to eliminate odors from residues which might remain in the water closet. If desired, the liquid may include odor absorbent or odor neutralizing materials, as known in the art, which serve to negate the effects of odors, without deodorizing the room with a definite scent. The recesses 60 in the ledge 58 retain a portion of the additive liquid 66, thus preventing dilution of the deodorizer in the additive liquid by the water supply, and permitting dissipation of the deodorizer throughout the room. Dissipation of the deodorizer throughout the room is facilitated by the water as it rises from the second level B to the first upper level A during a flushing cycle, since air in the tank carrying the deodorizer is forced upwardly by the rising water and out of the tank. If desired, the ledge 58 may be moved to its second position spaced from the path of the additive liquid into the tank. In this configuration, the deodorizer is diluted by the large supply of water, thus rendering the deodorizer ineffective. Accordingly, the user may select whether to deodorize the room by suitable movement of the ledge.

It is apparent that additional amounts of the additive liquid will be introduced into the tank water *w* upon subsequent flushing cycles of the water closet. As previously noted, when the water closet is flushed and the water lowers from the first level A toward the second level B, a slight vacuum may be created by the water in the air chamber 32, but the one-way valve 36 prevents passage of fluid from the container 24 to the air chamber 32. Again, when the water level is located below the inlet opening 34, air passes into the air chamber 32, and is forced through the one-way valve 36 and the first lumen 38 into the container chamber 64 where it is compressed, as the water level rises above the inlet opening, after which an additional amount of the additive liquid 66 is forced by the compressed air through the second lumen 44 and the outlet opening 46 into the tank water. Thus, an approximately equal amount of the additive liquid is introduced into the water responsive to each flushing, and the device of the present invention prevents introduction of too large or too small an amount of the additive liquid into the water.

Accordingly, as the water closet is repetitively flushed throughout a substantial period of time a substantial amount of the additive liquid 66 is introduced into the water closet, and the second liquid 70 is introduced into the tank water when the supply of first liquid is exhausted. Since the second liquid 70 has a color which contrasts with the first liquid 68, appearance of the color of the second liquid 70 in the water serves as an indication that the supply of additive liquid is nearly depleted, and that the container should be replaced.

Since the containers 24 are retained outside the tank T, they may be replaced without removing the cover C of the water closet W. The used container 24 may be readily removed by unthreading the rim 94 from the used container. The cap 92 is then removed from the replacement container, and the replacement container is attached to the connector 22 by the threaded rim 94, as previously described. The cap 92 from the replacement container may be utilized to cover the used container and permit easy and convenient disposal of the old container. Thus, according to the present invention, the containers may be replaced in a simple and expeditious manner, without wetting of the user's hands with tank water, without spilling additive liquid during replacement, and without staining the user's hands with dye.

Although it is desired that the container 24 be located outside the tank for easy replacement, if a user desires to place the container inside the tank T, the connector 22 may be provided with a hook 98, as shown in FIG. 2. Thus, the hook 98 is attached to the rim R of the tank T with the connector 22 and the container 24 is located inside the tank. For this use of the device, the second end portion 30 of the connector 22 may be modified to retain the container 24 in a more elevated position relative the upper water level A. In Addition, if desired, the connector 22 and the receptacle 24 may be made integral for a single use, after which both units are discarded.

Figure 9:
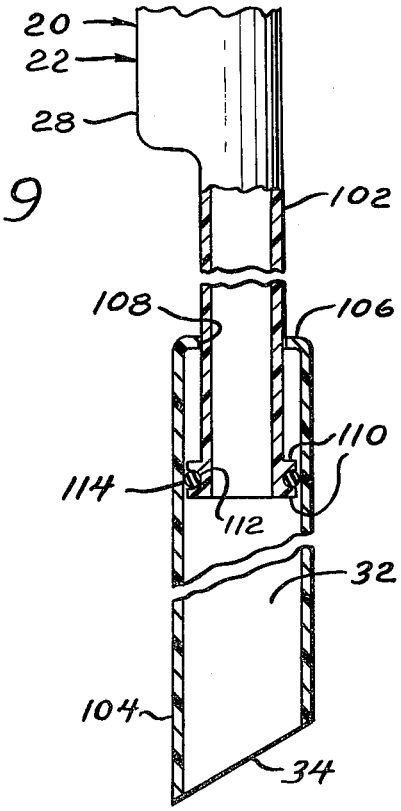
FIG. 9 is a fragmentary sectional view of another embodiment of the connector of the present invention.

It may also be desirable to provide for height adjustment of the connector inlet opening 34. As shown in FIG. 9, the first end portion 28 of the connector may have an upper first section 102 and a lower second section 104 defining the inlet opening 34 and being slidably mounted on the first section 102, with the air chamber 32 extending through both sections 102 and 104. The upper end of the second section 104 has an inwardly directed annular flange 106 defining an opening 108 through which the lower portion of the first section 102 is received. The lower end of the first section 102 may have a pair of spaced outwardly directed flanges 110 defining an annular groove 112. A flexible sealing ring 114 is received in the groove 112 and is held in sealing engagement against the inner surface of the second section 104. Thus, the second section 104 is movable longitudinally along the first section 102 to adjust the height of the inlet opening 34 relative the lower water level in the tank, such that the device 20 may readily be used on water closets having tanks of varying heights. The sealing ring 114 prevents escape of fluid between the outer surface of the first section 102 and the inner surface of the outer section 104.

The foregoing detailed description is given for clearness of understanding only, and no unnecessary limitations should be understood therefrom, as modifications will be obvious to those skilled in the art.

I claim:

1. A device for introducing an additive liquid into a water closet of the type having a tank for retaining a flushing liquid which lowers and rises between a first upper level and a second lower level during flushing, comprising:

container means for retaining the additive liquids;

first conduit means communicating between said container means and inlet opening means positionable in said tank intermediate said first and second levels of the flushing liquid to admit air into the first conduit means when the flushing liquid lowers below the inlet opening means, said inlet opening means being positionable sufficiently below said first level for the flushing liquid to force air through the first conduit means into the container means as the flushing liquid rises above the inlet opening means toward said first level;

one-way valve means associated with the first conduit means for permitting passage of air from said inlet opening means to the container means and for preventing passage of fluid from the container means to the inlet opening means; and second conduit means communicating between said additive liquid in the container means and outlet opening means positionable in the tank for passage of additive liquid into the flushing liquid, whereby the air forced into the container means forces a portion of the additive liquid from the container means through the second conduit means and outlet opening means into the flushing liquid in said tank.

2. The device of claim 1 wherein said additive liquid comprises a cleaning solution.

3. The device of claim 1 wherein said additive liquid includes a deodorant.

4. The device of claim 1 wherein said additive liquid includes a first liquid and a visual indicating material having a density less than the density of said first liquid.

5. The device of claim 4 wherein said visual indicating material comprises a second liquid having a color which contrasts to the color of the first liquid.

6. The device of claim 1 wherein the outlet opening means is positionable in the tank above the first level of the flushing liquid.

7. The device of claim 6 including ledge means positionable intermediate the outlet opening means and the first level of the flushing liquid for breaking the flow of the additive liquid into the flushing liquid.

8. The device of claim 7 wherein said ledge means includes pocket means to receive and retain a portion of said additive liquid.

9. The device of claim 8 wherein said ledge means includes a surface facing toward the outlet opening means and said pocket means comprises a plurality of recesses in said surface.

10. The device of claim 7 including means for selectively moving the ledge means remote the path of said additive liquid from the outlet opening means.

11. The device of claim 10 wherein the moving means comprises means for rotably supporting the ledge means on the first conduit means for rotation of the ledge means about the first conduit means between a first position with the ledge means located in the path of the additive liquid from the outlet opening means and a second position spaced from the path of the additive liquid from the outlet opening means.

12. The device of claim 1 wherein the first conduit means includes an elongated air chamber adjacent one end of the conduit means and defining said inlet opening means.

13. The device of claim 12 wherein the valve means is located intermediate said air chamber and the container means.

14. The device of claim 12 wherein said air chamber extends from the inlet opening means to a location positionable above the first level of the flushing liquid.

15. The device of claim 1 wherein the inlet opening means is positionable adjacent the second level of the flushing liquid.

16. The device of claim 1 wherein the container means is separable from at least a portion of the first and second conduit means.

17. The device of claim 1 including means for releasably attaching the container means to the first and second conduit means.

18. The device of claim 17 wherein the second conduit means includes a separate end section in the container means communicating with the additive liquid, and including means for connecting said end section to the remainder of the second conduit means responsive to attachment of the container means by the attaching means.

19. The device of claim 1 wherein the container means includes a connecting portion having first and second aperture means, said first conduit means includes a first connecting tube adjacent one end, said second conduit means includes a first end section in the container means communicating between the second aperture means and the additive liquid and a second end section having a second connecting tube adjacent one end, and including means for removably attaching the container means to the first conduit means and the second end section of the second conduit means with the first connecting tube communicating with the inside of the container means through the first aperture means and with the second connecting tube communicating with the first end section of the second conduit means through the second aperture means.

20. The device of claim 19 wherein the first end section of the second conduit means communicates with a lower end of the container means.

21. The device of claim 19 wherein the first connecting tube communicates with the inside of the container means adjacent an upper end of the container means.

22. The device of claim 19 wherein the first and second connecting tubes are spaced and generally aligned and the first and second aperture means are spaced from each other in the connecting portion of the container means to receive the first and second tube sections.

23. The device of claim 19 including means for preventing fluid leakage from the attached container means and first and second conduit means.

24. The device of claim 23 including a first sealing surface surrounding said first and second connecting tubes, and in which said connecting portion of the container means includes a second sealing surface engaging against the first sealing surface when the container means is attached to the first and second conduit means to prevent fluid leakage.

25. The device of claim 24 including a resilient sealing member defining one of said sealing surfaces.

26. The device of claim 19 wherein the attaching means comprises rotably mounted rim means having a rim portion surrounding the first and second tube sections and being removably securable to the connecting portion of the container means.

27. The device of claim 19 including means for closing said first and second aperture means, and in which said first and second connecting tubes open the closing means of the first and second aperture means during attachment of the container means.

28. The device of claim 1 wherein the container means is positionable outside the tank.

29. The device of claim 28 wherein said first and second conduit means includes a central portion positionable in an overlying relationship on an upper rim of the tank, a first end portion depending from the central portion including said inlet and outlet opening means and being positionable in the tank, and a second end portion extending from the central portion and communicating with the container means, said second end portion being positionable outside the tank.

30. The device of claim 1 wherein the first and second conduit means include a depending first end portion including the inlet and outlet opening means, a second end portion communicating with the container means, and hook means for supporting the first and second outlet means on an upper rim of the tank.

31. The device of claim 1 including means for supporting the first and second conduit means on the water closet with the first and second conduit means located in the reservoir tank.

32. The device of claim 1 wherein the second conduit means communicates with the additive liquid adjacent a lower end of the container means.

33. The device of claim 1 wherein the first conduit means communicates with an upper end of the container means.

34. The device of claim 1 including means for adjusting the height of the inlet opening means relative the lower level of the flushing liquid.

35. The device of claim 34 wherein the first conduit means includes an elongated air chamber adjacent one end of the conduit means and defining said inlet opening means, the container means is positionable outside the tank, said first and second conduit means include a central portion positionable in an overlying relationship on an upper rim of the tank, a first end portion depending from the central portion including said inlet and outlet opening means and being positionable in the tank, and a second end portion extending from the central portion and communicating with the container means, said second end portion being positionable outside the tank, and in which the adjusting means comprises, a first elongated upper section of said first end portion, and a second lower elongated section of said first end portion, said second section being movable along said first section.

36. A device for introducing an additive liquid into a water closet of the type having a tank for retaining a flushing liquid which lowers and rises between a first upper level and a second lower level during flushing, comprising:

a connector having a central portion for placement on an upper rim of the tank, a first end portion depending from the central portion for placement in the tank, and a second end portion extending from the central portion for placement outside the tank, an elongated air chamber in the first end portion having inlet means positioned a substantial distance below the first level of the flushing liquid and above the second level to admit air when the flushing liquid is below the inlet means, a first lumen extending through the connector and communicating between the air chamber and first aperture means in the second end portion, and a second lumen extending between second aperture means in the second end portion and outlet means in the first end portion, said outlet means being located for depositing liquid in the flushing liquid, said device being positionable on the water closet with the connector extending over the upper rim of the tank to permit placement of a cover for the water closet on the tank and over said connector; and one-way valve means associated with the first lumen for permitting passage of air from the air chamber to the first aperture means and preventing passage of fluid from the first aperture means to the air chamber.

37. The device of claim 36 including a container having a chamber for retaining an additive liquid, and means for releasably attaching the container to the second end portion with the first aperture means communicating with the chamber and the second aperture means communicating with the additive liquid in the chamber.

38. The device of claim 37 wherein the connector includes first and second spaced tube sections extending from said second end portion, with said first tube section communicating with the first lumen and defining the first aperture means, and with the second tube section communicating with the second lumen and defining the second aperture means, in which said container includes a top portion, first and second opening means extending through the top portion with said first opening means communicating with an upper end of the chamber, in which said container includes tube means communicating between the second opening means and a lower end of the chamber, and in which said first and second tube sections are received in the first and second opening means when the container is attached to the connector, with the first aperture means communicating with an upper end of the chamber, and with the second aperture means communicating with the tube means.

39. The device of claim 36 wherein the container includes a top portion having a first sealing surface, and the second end portion of the connector includes a second sealing surface for sealingly engaging with said first surface when the container is attached to the connector.

40. The device of claim 38 wherein the container includes a top portion having a first sealing surface, and the second end portion of the connector includes a second sealing surface for sealingly engaging with said first surface when the container is attached to the connector, and in which said first sealing surface surrounds the first and second opening means, the second sealing surface surrounds the first and second tube sections, and the attaching means comprises a rim means at least partially surrounding the first and second tube sections and being rotatably mounted on the second end portion of the connector, said rim means being cooperatively engageable with said top portion of the container.

41. The device of claim 36 including means for adjusting the distance between said inlet means and the central portion of the connector.

42. A receptacle comprising, a container having a chamber for retaining a liquid, a top member having first and second bores extending at least partially through the top member and having an integral film closing the first and second bores, and a first tube extending from one of said bores to a lower end of the chamber, and a resilient flexible sealing member secured to an outer surface of the top member and defining an outer sealing surface for the container.

43. The receptacle of claim 42 wherein the film is located adjacent an outer end of the top member.

44. The receptacle of claim 42 including a second tube communicating between the other of said bores and an upper end of the chamber.

45. The receptacle of claim 42 wherein said resilient member includes a pair of openings extending through the resilient member and aligned with the first and second bores.

46. The receptacle of claim 42 including a cap removably secured to the top member.

* * * * *